United States Patent [19]

Fong et al.

[11] Patent Number: 4,964,870

[45] Date of Patent: Oct. 23, 1990

[54] BLEACHING WITH PHENYLENE DIESTER PERACID PRECURSORS

[75] Inventors: Ronald A. Fong, Modesto; Stephen B. Kong, Alameda, both of Calif.

[73] Assignee: The Clorox Company, Oakland, Calif.

[21] Appl. No.: 366,192

[22] Filed: Jun. 8, 1989

Related U.S. Application Data

[63] Continuation of Ser. No. 681,983, Dec. 14, 1984, abandoned.

[51] Int. Cl.[5] ..... D06L 3/02; C11D 3/395; C11D 7/54

[52] U.S. Cl. ..... 8/111; 252/95; 252/186.38; 252/186.41; 8/101

[58] Field of Search ..... 252/186.38, 186.41, 252/95; 8/101, 111

[56] References Cited

U.S. PATENT DOCUMENTS

| | | | |
|---|---|---|---|
| 2,082,790 | 6/1937 | Cherry | 260/99.40 |
| 2,134,388 | 10/1938 | Cherry | 260/479 |
| 2,345,006 | 3/1944 | Ross et al. | 260/410.5 |
| 2,783,132 | 2/1957 | Panepinto | 23/207.5 |
| 3,130,165 | 4/1964 | Brocklehurst et al. | 252/59 |
| 3,163,606 | 12/1964 | Viveen et al. | 252/98 |
| 3,374,177 | 3/1968 | Schmidt et al. | 252/186 |
| 3,415,608 | 12/1968 | Tucker | 8/10.2 |
| 3,462,468 | 8/1969 | Taylor et al. | 260/410.5 |
| 3,542,852 | 11/1970 | Selwitz | 260/476 |
| 3,597,362 | 8/1971 | Bollyky et al. | 252/186 |
| 3,624,135 | 11/1971 | Kablaoui | 260/479 R |
| 3,624,136 | 11/1971 | Kablaoui | 260/479 R |
| 3,631,227 | 12/1971 | Kablaoui et al. | 260/479 R |
| 3,661,789 | 5/1972 | Corey et al. | 252/186 |
| 3,869,401 | 3/1975 | Ernst | 252/186 |
| 3,899,520 | 8/1975 | Van Leuwen et al. | 260/414 |
| 3,969,383 | 7/1976 | Dexter et al. | 260/410.5 |
| 3,974,086 | 8/1976 | Rauhut et al. | 252/188.3 |
| 4,011,181 | 3/1977 | Van Leuwen et al. | 260/2.5 AB |
| 4,022,703 | 5/1977 | Bakes et al. | 252/100 |
| 4,036,773 | 7/1977 | Okorodudu | 252/56 R |
| 4,140,846 | 2/1979 | Jackson et al. | 528/193 |
| 4,145,183 | 3/1979 | Bastwick | 252/186 |
| 4,146,496 | 3/1979 | Gray | 252/99 |
| 4,154,695 | 5/1979 | McCrudden et al. | 252/99 |
| 4,181,792 | 1/1980 | Jackson et al. | 528/190 |

(List continued on next page.)

OTHER PUBLICATIONS

E. Müller, Methoden der Organischen Chemie, 4th Ed., vol. VIII, pp. 547–549 (1952) (translated).

Kirk-Othmer *Encyclopedia of Chemical Technology*, 3rd. ed. vol. 13, "Hydroquinones, Resorcinol, and Catechol," pp. 39–69 (1981).

D. Johnson, "Preparation of Hydroquinone Monoacetate," *Chemistry and Industry*, vol. 24, p. 1000 (1982).

Chem. Abs. 98:54599u (1983).

Chem. Abs. 96:123436m (1982).

(List continued on next page.)

*Primary Examiner*—Edward A. Miller

*Attorney, Agent, or Firm*—Joel J. Hayashida; Michael J. Mazza; Stephen M. Westbrook

[57] ABSTRACT

The invention provides novel peracid precursors representative of which is the structure:

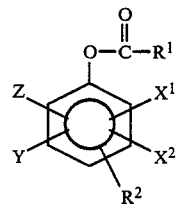

wherein $R^1$ is alkyl of 1 to 20 carbon atoms; $R^2$ is OH, —O—$R^3$, or

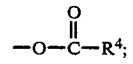

and $X^1$, $X^2$, Y and Z are individually selected from H, $SO_3^-$, $CO_2^-$, $NO_2$, $NR_4^{5+}$, halogen, $R^6$ and mixtures thereof;

wherein $R^3$ of —O—$R^3$ is alkyl of 1 to 20 carbon atoms; $R^4$ of

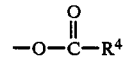

is alkyl of 1 to 20 carbon atoms; $R^5$ of $NR_4^{5+}$ is selected from H, alkyl of 1 to 24 carbon atoms and mixtures thereof; and $R^6$ is alkyl of 1 to 20 carbon atoms.

In one embodiment of the invention, the novel peracid precursors are combined with a source of hydrogen peroxide and sufficient quantities of buffer to impact an alkaline pH when the composition is placed in aqueous solution. Preferred embodiments of the invention include wherein $R^2$ is hydroxy, and $R^1$ is alkyl of 1 to 20 carbon atoms (monoester); and wherein $R^2$ is

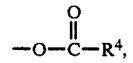

and $R^1$ and $R^4$ are alkyls of 1 to 20 carbon atoms (diester) and may be either symmetrical (i.e., $R^1=R^4$) or mixed (i.e., $R^1 \neq R^4$). The mixed diester embodiment appears to provide benefits of mixed hydrophobic/hydrophilic peracid generation to oxidize both hydrophobic and hydrophilic soils. Various detergent adjuncts known to those skilled in the art may be added, such as surfactants, builders, fragrances, antimicrobial compounds and the like.

22 Claims, No Drawings

U.S. PATENT DOCUMENTS

| | | | |
|---|---|---|---|
| 4,201,856 | 5/1980 | Jackson et al. | 528/190 |
| 4,221,675 | 9/1980 | Schirmann et al. | 252/186 |
| 4,225,451 | 9/1980 | McCrudden et al. | 252/99 |
| 4,283,301 | 8/1981 | Diehl | 252/102 |
| 4,292,191 | 9/1981 | Gray | 252/186 |
| 4,321,157 | 3/1982 | Harris et al. | 252/174.25 |
| 4,360,658 | 11/1982 | Jackson et al. | 528/193 |
| 4,367,156 | 1/1983 | Diehl | 252/102 |
| 4,372,868 | 2/1983 | Saran et al. | 252/102 |
| 4,374,035 | 2/1983 | Bossu | 252/91 |
| 4,374,747 | 2/1983 | Tai | 252/186.26 |
| 4,391,724 | 7/1983 | Bacon | 252/90 |
| 4,391,725 | 7/1983 | Bossu | 252/90 |
| 4,397,757 | 8/1983 | Bright et al. | 252/186.41 |
| 4,412,934 | 11/1983 | Chung et al. | 252/186.38 |
| 4,444,674 | 4/1984 | Gray | 252/95 |
| 4,478,754 | 10/1984 | Kong-Chan | 260/410.5 |
| 4,483,778 | 11/1984 | Thompson et al. | 252/94 |
| 4,486,327 | 12/1984 | Murphy et al. | 252/94 |
| 4,514,444 | 4/1985 | Ives et al. | 427/242 |
| 4,547,305 | 10/1985 | Cornelissen et al. | 252/186.38 |
| 4,613,332 | 9/1986 | Casella | 8/111 |
| 4,619,779 | 10/1986 | Hardy | 252/186.26 |
| 4,727,182 | 2/1988 | Ratton | 560/144 |
| 4,772,290 | 9/1988 | Mitchell et al. | 252/186.23 |
| 4,814,110 | 3/1989 | Fong et al. | 260/400 |

OTHER PUBLICATIONS

Chem. Abs. 95:114963h (1981).
Chem. Abs. 81:120210n.
Chem. Abs. 78:43934k.
Chem. Abs. 71:3758e.
Chem. Abs. 98:89726k.
Chem. Abs. 95:98126c (1981).
Chem. Abs. 91:193238u (1979).
Chem. Abs. 86:155365x (1977).
Chem. Abs. 79:136841p (1973).
Chem. Abs. 76:72219v (1972).
Chem. Abs. 73:45782e (1970).
Chem. Abs. 92:216031h (1980).
Chem. Abs. 73:7263d (1970).
Chem. Abs. 98:126848z (1983).
Chem. Abs. 92:77368h (1980).
Chem. Abs. 90:204846y (1979).
Chem. Abs. 89:42760r.

Vellaccio et al., *J. Org. Chem.*, vol. 46, pp. 3087–3091 (1981).

Snell et al., *J. Org. Chem.*, vol. 48, pp. 5106–5107 (1983).

Karkhanis et al., *J. Pharm. Sci.*, vol. 62, pp. 804–806 (1973).

Kurlansik et al., *J. Pharm. Sci.*, vol. 57, pp. 475–477 (1968).

Hocking et al., *Can. J. Chem.*, vol. 56, pp. 2646–2649 (1979).

Johnson et al., *Tetrahedron Letters*, vol. 22, pp. 3715–3718 (1981).

BLEACHING WITH PHENYLENE DIESTER PERACID PRECURSORS

This is a continuation of application Ser. No. 681,983, filed Dec. 14, 1984.

FIELD OF THE INVENTION

This relates to novel peracid precursors and the in situ generation of peracid in aqueous solution by combining a source of hydrogen peroxide, and the novel peracid precursor, exemplary of which are phenylene mono—and diesters, in water, said precursors being of the general structure:

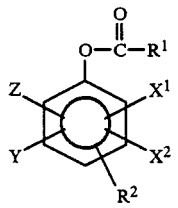

wherein $R^1$, $R^2$, $X^1$, $X^2$, Y and Z are defined within the specification.

BACKGROUND OF THE INVENTION

Peroxygen bleaching compounds, such as hydrogen peroxide, sodium percarbonate, sodium perborate monohydrate or tetrahydrate, are useful for bleaching fabrics, textiles and other materials. Unfortunately, these sorts of peroxygen bleaches appear less effective when bleaching temperatures of less than 70° C. are utilized. Thus, the low wash temperatures found in American washing machines make the use of these bleaches less effective than in European-type washing machines, which typically use water temperatures above 70° C. Therefore, attempts have been made to use activators in combination with these peroxygen bleaches. It may be more accurate to call these activators peracid precursors, since it is generally accepted that when a molecule of a compound such as sodium acetyloxy benzene sulfonate ("NABS") is combined with a source of hydrogen peroxide, such as sodium perborate monohydrate, in aqueous solution (as indicated in GB No. 864,798), the result is production of peracetic acid,

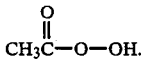

However, nothing within the prior art shows, discloses, or suggests that di-substituted benzenes, more specifically, phenylene diesters, may be appropriate for use as peracid precursors.

SUMMARY OF THE INVENTION

The invention provides a compound of the general structure

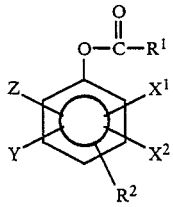

wherein $R^1$ is alkyl of 1 to 20 carbon atoms; $R^2$ is OH, —O—$R^3$, or and $X^1$, $X^2$, Y and Z are individually selected from H, $SO^-_3$, $CO^-_2$, $NO_2$, $NR^{5+}_4$, halogen, $R^6$ and mixtures thereof;

wherein $R^3$ of —O—$R^3$ is alkyl of 1 to 20 carbon atoms; $R^4$ of

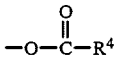

is alkyl of 1 to 20 carbon atoms; $R^5$ of $NR^{5+}_4$ is selected from H, alkyl of 1 to 24 carbon atoms and mixtures thereof; and $R^6$ is alkyl of 1 to 20 carbon atoms;

wherein when $R^2$ is OH, $R^1$ has more than about 3 carbon atoms; and wherein when $R^2$ is

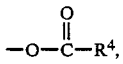

and $R^1$ and $R^4$ comprise individually alkyls of less than 3 carbon atoms, $R^1 \neq R^4$.

The invention also provides a solid or liquid bleaching composition comprising:

(a) A hydrogen peroxide source; and (b) A bleach effective amount of a precursor of the general structure:

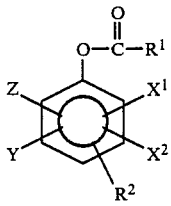

wherein $R^1$ is alkyl of 1 to 20 carbon atoms; $R^2$ is OH, —O—$R^3$, or

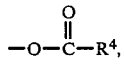

and $X^1$, $X^2$, Y and Z are individually selected from H, $SO^-_3$, $CO^-_2$, $NO_2$, $NR^{5+}_4$, halogen, $R^6$ and mixtures thereof;

wherein $R^3$ of —O—$R^3$ is alkyl of 1 to 20 carbon atoms; $R^4$ of

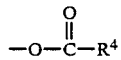

is alkyl of 1 to 20 carbon atoms; $R^5$ of $NR^{5+}_4$ is selected from H, alkyl of 1 to 24 carbon atoms and mixtures thereof; and $R^6$ is alkyl of 1 to 20 carbon atoms.

Preferred embodiments include phenylene monoesters wherein $R^2$ is OH and $R^1$ is straight chain alkyl of 1 to 11 carbon atoms; and phenylene diesters wherein $R^2$ is

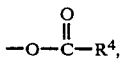

both $R^2$ and $R^4$ straight chain comprising alkyls of 1 to 11 carbon atoms.

Selected adjuncts can be added to these bleaching compositions, such as surfactants, stabilizers, buffers and builders. The invention also includes a method for synthesizing the above noted precursor compounds and method of bleaching.

DETAILED DESCRIPTION OF THE INVENTION

The invention generally relates to novel peracid precursors Typical precursors are esters, imide or enol ester compounds which are combined with a source of peroxygen, such as hydrogen peroxide, sodium percarbonate or sodium perborate. These particular types of precursors are commonly used in Europe where washing temperatures are generally higher than is prevalent in the United States. Washing temperatures of up to 100° C. are common in Europe.

However, there remains a need to provide peracid precursors which are effective to promote good bleaching in wash temperatures below 70° C., more preferably below 60° C., and most preferably below 50° C.

The preferred peracid precursors of this invention have the general structure:

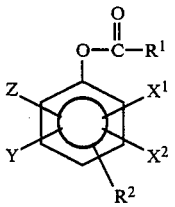

wherein $R^1$ is alkyl of 1 to 20 carbon atoms; $R^2$ is OH, —O—$R^3$, or and $X^1$, $X^2$, Y and Z are individually selected from H, $SO^-_3$, $CO^-_2$, $NO_2$, $NR^{5+}_4$, halogen, $R^6$ and mixtures thereof;

wherein $R^3$ of —O—$R^3$ is alkyl of 1 to 20 carbon atoms; $R^4$ of

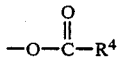

is alkyl of 1 to 20 carbon atoms; $R^5$ of $NR^{5+}_4$ is selected from H, alkyl of 1 to 24 carbon atoms and mixtures thereof; and $R^6$ is alkyl of 1 to 20 carbon atoms;

wherein when $R^2$ is OH, $R^1$ has more than about 3 carbon atoms; and wherein when $R^2$ is

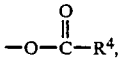

and $R^1$ and $R^4$ comprise individually alkyls of less than 3 carbon atoms, $R^1 \neq R^4$.

The embodiments of this general structure include:

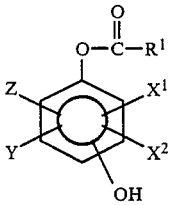

(I)

wherein $R^1$, $X^1$, $X^2$, Y and Z are defined as above;

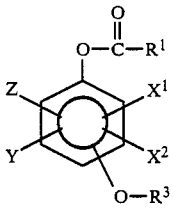

(II)

wherein $R^1$, $R^3$, $X^1$, $X^2$, Y and Z are defined as above; and

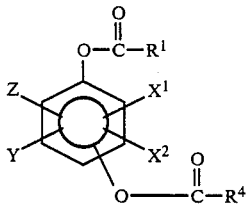

(III)

wherein $R^1$, $R^4$, $X^1$, $X^2$, Y and Z are defined as above.

The substituents $R^1$, $R^4$ and $R^6$, all being alkyls of 1 to 20 carbon atoms, may additionally be either straight chain, branched chain, have some unsaturation (for example, if $R^1$, $R^4$ or $R^6$ is derived from natural oils or fatty acids, e.g., oleic acid), and may be substituted at various positions on the carbon chain. Substituents of $R^1$, $R^4$ and $R^6$ may include halogen ($Cl^-$, $Br^-$, $I^-$), $NO_2$, $NR^{5+}_4$ ($R^5$ defined as in the foregoing, and representing, e.g., $NH_4$ and other quaternary ammonium compounds), $SO^-_4$, $CO^-_2$, and OH.

With respect to the ring substituents $X^1$, $X^2$, Y and Z, which are selected from H, $SO^-_3$, $CO^-_2$, $NO_2$, $NR^{5+}_4$, halogen, $R^6$ and mixtures thereof (wherein $R^5$ of $NR^{5+}_4$ is selected from H, alkyl of 1-24 carbon atoms, and mixtures thereof; and $R^6$ is alkyl of 1 to 20 carbon atoms), any combination of these substituents may be present in the precursors of this invention. When the substituents are charged moieties, e.g. $SO^-_3$, appropriate counterpart ions (counterions) may be present. With respect to $SO^-_3$, $CO^-_2$, $Cl^-$, $Br^-$, and $F^-$, appropriate counterions may be chosen from $H^+$, alkali metal salts ($Na^+$, $Li^+$, $K^+$), although alkaline earth salts (calcium, magnesium, barium) or even ammonium salts may be possible. With respect to a quaternary ammonium substituent, i.e., $NR^{5+}_4$, appropriate counterions can include halides, ($CI^-$, $Br^-$, $I^-$), methosulfates, sulfates and nitrates. These aforementioned counterions may also be present with respect to the substituted $R^1$, $R^4$ and $R^6$ groups, as appropriate.

When compounds of (I), i.e., phenylene monoesters, are considered, it is preferred that $R^1$ comprise alkyl of 1 to 20, more preferably 1 to 15, and most preferably 1 to 11 carbon atoms. Particularly preferred are phenylene monoesters of about 6–11 carbon atoms in length, which appear to provide surface active peracids when combined with a hydrogen peroxide source in aqueous solution As exemplified below, in EXPERIMENTAL, Example II, these particular compounds were found to be excellent in perhydrolysis, giving good yields of the desired peracid, with surprisingly low levels of diacyl peroxide, which, as described in Chung it al, U.S. Pat. No. 4,412,934, may be problematic.

Compounds of (II), i.e., phenylene esters with an ether substituent, —O—$R^5$, wherein $R^5$ is alkyl of 1 to 20, more preferably 1 to 10, and most preferably 1 to 6, carbon atoms, may be very reactive compounds. Especially preferred may be when $R^5=CH_3$. As with the substituents $R^1$, $R^4$ and $R^6$, $R^5$ may be straight chain, branched, unsaturated or substituted.

With compounds of (III), i.e., phenylene diesters, wherein $R^2$ *is*

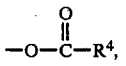

$R^1$ and $R^4$ are preferably 1 to 20, more preferably 1 to 15, and most preferably 1 to 11 carbon atoms. These particular compounds have the advantages of containing two potential sites for perhydrolysis and thus appear to greatly increase peracid yields over prior art precursors when the same amount of precursors, based on molar equivalents, is used. Additionally, unexpected salutary benefits appear when $R^1$ and $R^4$ are unequal, i.e., the compound is a mixed diester. In particular when $R^1$ or $R^4$ is less than 5 carbons, and the other is greater, it is believed that both hydrophobic and hydrophilic peracids are generated. Therefore, if used in aqueous media with a source of hydrogen peroxide (e.g., sodium perborate monohydrate), for example, as an all fabric bleach, two different oxidizing species appear to be present which can attach to different types of soils, i.e., hydrophilic soils such as tea and wine, and oily soils, such as sebum.

The phenylene diesters of (III) include ortho, meta and para-substituted phenylene diesters, such as diacetate, dihexanoate, dioctanoate and mixed (i.e., wherein $R^1 \neq R^4$) ester derivatives of resorcinol, hydroquinone and catechol, which are exemplified below:

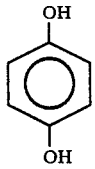

Hydroquinone (1,4-benzenediol; 1,4-dihydroxybenzene; p-dihydroxybenzene) is a white crystalline compound which can be obtained by dry distillation of quinic acid or by reduction of quinone.

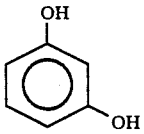

Resorcinol (1,3-benzenediol: 1,3-dihydroxybenzene: m-dihydroxybenzene) is a crystalline compound with a faint aromatic odor, and a sweet/bitter taste. It may be produced by the alkali fusion of galbanum and asafetida resins.

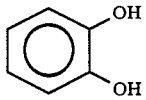

Catechol (1,2-benzenediol; 1,2-dihydroxybenzene; o-dihydroxybenzene) is a crystalline compound with a phenolic odor and a sweet and bitter taste. It may be obtained by dried distillation of catechin which is found in the aqueous extract of catechu, which is an extract of an East Asian acacia plant.

All three of these dihydroxybenzene starting materials are commercially available.

The dihydroxybenzenes are weak acids with two dissociation constants. They are generally classified as antioxidant agents and are useful analytical reagents. Their structures, uses and chemistries are more thoroughly explored in Kirk-Othmer, *Encyclopedia of Chemical Technology,* 3rd Ed., vol 13, pages 39–69 (1981), which pages are incorporated herein by reference.

The diesterified derivatives of these dihydroxybenzene compounds are generally produced by reacting them with an appropriate acid anhydride in the presence of a strong acid. The general procedures for making these precursors are set forth below in EXPERIMENTAL. Additionally, the preferred phenylene monoesters are depicted below in EXPERIMENTAL.

It is believed that in situ peracid generation occurs when these novel precursors are combined with a source of hydrogen peroxide in aqueous solution as follows:

Step I

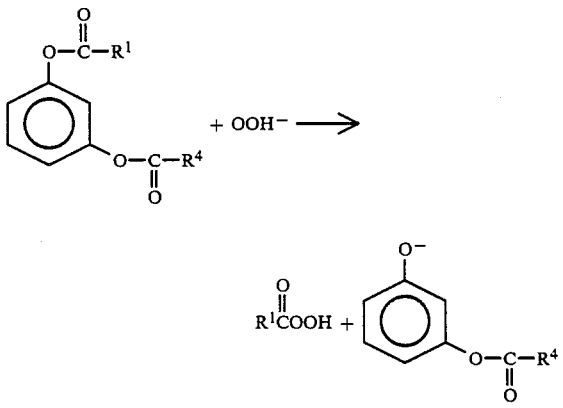

Step II

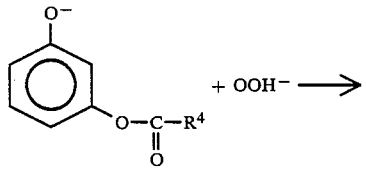

-continued

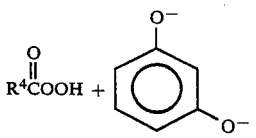

wherein the phenylene diester precursors revert back to the appropriate dihydroxybenzene compound.

While the foregoing is believed to occur, in fact, the mechanism behind peracid generation may occur simultaneously, or in rapid sequence, or a combination of these reactions.

Whatever the mechanism, it was surprisingly discovered that when the novel precursors were combined with hydrogen peroxide in aqueous solution, high yields of peracid were produced, even at low temperatures such as those found in U.S. wash water temperatures. It was even move surprising to see these high yields given that the byproducts of reaction, dihydroxybenzenes, are noted antioxidants which one would expect to consume the peracids thus produced.

Applicants have found these particular substituted phenylene diesters to be particularly effective in low temperature bleaching applications. It was surprising that, given the large number of carbons on the disclosed compositions, the reactivities thereof were suitable for low temperature bleaching applications. Large alkyl groups are hydrophobic, hence solubility or dispersibility in cold water was assumed to be problematic. While enhanced bleaching activity occurs when various solubilizing groups are added to these compositions, sufficient peroxyacid generation for bleach applications has been observed even in their absence.

Additionally, applicants observed that with increasing chain lengths of the phenylene diester precursors, decreasing bleaching performance may be observed due to decreasing solubility or dispersibility. Therefore, solubility/dispersibility and hence performance can be improved by the addition of solubilizing groups such as $SO^{-}{}_{3}$, $CO^{-}{}_{2}$, $NR^{3+}{}_{4}$. Placement of these solubilizing groups may have different effects on the precursor compositions. For example, if the solubilizing groups are placed on the aromatic ring or at or near the end of the alkyl groups of the esters, increased solubility may be observed Placing the solubilizing groups next to the carbonyl carbon on the ester group or electron withdrawing substituents on the aromatic leaving group may increase the perhydrolysis rate These theories are by way of explanation and not intended to thereby restrict the invention herein.

Addition of the above described substituent groups can be accomplished by ways known to those skilled in the art. For example, halogen groups may be added by typical halogenation reactions, in which a typical source of halogen is combined with the selected dihydroxybenzene starting material in the presence of a Lewis Acid. Nitration, on the other hand, occurs when the dihydroxybenzene is reacted with nitric acid in the presence of sulfuric acid. Sulfonation occurs when the dihydroxybenzene is reacted with concentrated sulfuric acid. On the other hand, amination will generally be produced by reacting a source of amino with the dihydroxybenzene in the presence of liquid ammonia. Further, as with typical benzene-derived compounds, acylation and alkylation can occur via Friedel-Crafts reactions.

Especially preferred are solubilizing groups, such as sulfonate ($—SO^{-}{}_{3}$) or carboxylate ($—CO^{-}{}_{2}$) groups. These appear to impart good solubility/dispersibility properties to the peracid precursors of this invention. Additionally, it is preferred that a counterpart ion (counterion) to the sulfonate or carbonate group be chosen from H+ or an alkali metal ion selected from sodium, potassium or lithium, although alkaline earth counterions and even ammonium counterions may be appropriate.

The precursors can be incorporated into a liquid or solid matrix for use in liquid or solid detergent bleaches by dissolving into an appropriate solvent or surfactant or by dispersing onto a substrate material. Examples of appropriate solvents include acetone, non-nucleophilic alcohols, ethers or hydrocarbons. Other more water-dispersible or -miscible solvents may be considered. As an example of affixation to a substrate material, the precursors of the present invention could be incorporated onto a non-particulate substrate such as disclosed in published European Patent Application EP No. 98 129, whose disclosure is incorporated herein by reference.

In a further embodiment of the phenylene diesters of this invention, it has been found that precursors containing mixed chain lengths, i.e., a shorter carbon chain length of at least one ester functionality, and a longer carbon length at the second ester functionality, provides extremely proficient bleaching. For example, it is believed that when one of the ester functionalities has an alkyl straight chain length of less than 5, e.g., wherein $R^1$ or $R^4$ is $CH_3$, and the other alkyl group's chain length is greater than 5 carbon atoms, peroxyacids which are, respectively, hydrophilic and hydrophobic are generated. The believed advantage thereof is that particulate soils, e.g., clay soil, and hydrophilic stains, e g , tea and wine, can be attacked with a hydrophilic peroxyacid bleach while oily soils, e.g., sebum, can be attacked with a hydrophobic peroxyacid bleach. Different pre-formed hydrophobic and hydrophilic peroxyacid bleaches were combined in published European Patent Application EP No. 68 547, whose disclosure is incorporated herein by reference. Pre-formed peracids appear, however, to have storage stability problems and may lose significant amounts of active oxygen (A.O) upon prolonged storage. EP No. 98 129, mentioned above, discloses in one embodiment, separate peracid precursors which are impregnated on a fabric substrate. Problematic to this approach are the added manufacturing steps to producing different peracid precursors and using slurrying, emulsifying or other techniques to bind the different precursors to the substrate. A particularly preferred combination of the present invention is when one ester is an acetate (e.g., $R^1$ is $CH_3$) and the other is an hexanoate, heptanoate, octanoate or nonanoate (e.g, $R^4$ is $—(CH_2)_4(CH_3$ to $—(CH_2)_7(CH_3)$. In a preferred embodiment, the total number of backbone carbons of $R^1$ plus $R^4$ should be in the range of 2–20, more preferably 5–20, most preferably 7–14.

Additionally, it was surprisingly found that while the positioning of the ester groups with respect to each other on the phenyl ring is significant, it is not critical. This was surprising since some references had suggested that activators which comprise a substituted phenyl ring must have the active substituent in para configuration with respect to other substituents, likely, it is assumed, to avoid steric hindrance.

Under wash conditions and at temperatures below 70° C., it has been surprisingly found that any dihydroxybenzene, whether catechol, hydroquinone or resorcinol, can be used as perhydrolysis leaving groups, and that the resulting antioxidant does not appreciably or rapidly consume the oxidant formed, i.e., the peroxyacid(s). Resorcinol and catechol may be the preferred leaving groups because, of the byproducts of perhydrolysis of ortho, meta and para phenylene diesters, hydroquinone may be the most readily oxidizable.

In the disclosure of Chung, et. al., U.S. Pat. No. 4,412,934, it is contended that the molar ratio of hydrogen peroxide to bleach activator must exceed 1.5 or else a competing reaction is favored wherein peracid generated reacts with the bleach activator itself to form diacyl peroxide. In contrast to the Chung, et. al. bleach activator, the present invention has been surprisingly discovered to form low levels of diacyl peroxide. This is further depicted below in EXPERIMENTAL, Examples II and IV. Although it is not definitely understood why this phenomenon occurs, it appears that the phenylene diester precursors may have different surface active properties. And, because of two reactive sites, which provides two equivalents of peracid per equivalent of precursor, lower concentrations of precursor are needed. There also is no need for a hydrogen peroxide/precursor ratio of greater than 1.5, as mandated in the Chung, et. at. disclosure. Based on two reactive sites, i e., the ester equivalents of the phenylene diester precursors, a ratio of 1:1 hydrogen peroxide: ester is possible, although ratios greater than this are also within the invention. It is preferred that the molar ratio of hydrogen peroxide: ester be from about 1:20 to 20:1, more preferably about 1:10 to 10:1, most preferably about 1:1 to 5:1.

While it has been disclosed by applicants that substituting solubilizing groups on the phenyl ring will improve the solubility and enhance the reactivity of these precursors, an alternate mode and preferred embodiment is to combine the precursors with a surfactant. Particularly effective surfactants appear to be nonionic surfactants. Preferred surfactants of use include linear ethoxylated alcohols, such as those sold by Shell Chemical Company under the brand name Neodol. Other suitable nonionic surfactants can include other linear ethoxylated alcohols with an average length of 6 to 16 carbon atoms and averaging about 2 to 20 moles of ethylene oxide per mole of alcohol; linear and branched, primary and secondary ethoxylated, propoxylated alcohols with an average length of about 6 to 16 carbon atoms and averaging 0–10 moles of ethylene oxide and about 1 to 10 moles of propylene oxide per mole of alcohol; linear and branched alkylphenoxy (polyethoxy) alcohols, otherwise known as ethoxylated alkylphenols, with an average chain length of 8 to 16 carbon atoms and averaging 1.5 to 30 moles of ethylene oxide per mole of alcohol; and mixtures thereof.

Further suitable nonionic surfactants may include polyoxyethylene carboxylic acid esters, fatty acid glycerol esters, fatty acid and ethoxylated fatty acid alkanolamides, certain block copolymers of propylene oxide and ethylene oxide, and block polymers of propylene oxide and ethylene oxide with propoxylated ethylene diamine. Also included are such semi-polar nonionic surfactants like amine oxides, phosphine oxides, sulfoxides, and their ethoxylated derivatives.

Anionic surfactants may also be suitable. Examples of such anionic surfactants may include the ammonium, substituted ammonium (e.g., mono-di-, and triethanolammonium), alkali metal and alkaline earth metal salts of $C_6$–$C_{20}$ fatty acids and rosin acids, linear and branched alkyl benzene sulfonates, alkyl sulfates, alkyl ether sulfates, alkane sulfonates, olefin sulfonates, hydroxyalkane sulfonates, fatty acid monoglyceride sulfates, alkyl glyceryl ether sulfates, acyl sarcosinates and acyl N-methyltaurides.

Suitable cationic surfactants may include the quaternary ammonium compounds in which typically one of the groups linked to the nitrogen atom is a $C_{12}$–$C_{18}$ alkyl group and the other three groups are short chained alkyl groups which may bear inert substituents such as phenyl groups.

Further, suitable amphoteric and zwitterionic surfactants which contain an anionic water-solubilizing group, a cationic group and a hydrophobic organic group may include amino carboxylic acids and their salts, amino dicarboxylic acids and their salts, alkylbetaines, alkyl aminopropylbetaines, sulfobetaines, alkyl imidazolinium derivatives, certain quaternary ammonium compounds, certain quaternary phosphonium compounds and certain tertiary sulfonium compounds. Other examples of potentially suitable zwitterionic surfactants can be found described in Jones, U.S. Pat. No. 4,005,029, at columns 11–15, which are incorporated herein by reference.

Further examples of anionic, nonionic, cationic and amphoteric surfactants which may be suitable for use in this invention are depicted in Kirk-Othmer, *Encyclopedia of Chemical Technology,* Third Edition, Volume 22, pages 347–387, and *McCutcheon's Detergents and Emulsifiers,* North American Edition, 1983, which are incorporated herein by reference.

As mentioned hereinabove, other common detergent adjuncts may be added if a bleach or detergent bleach product is desired. If, for example, a dry bleach composition is desired, the following ranges (weight %) appear practicable:

| | |
|---|---|
| 0.5–50.0% | Hydrogen Peroxide Source |
| 0.05–25.0% | Precursor |
| 1.0–50.0% | Surfactant |
| 1.0–50.0% | Buffer |
| 5.0–99.9% | Filler, stabilizers, dyes, Fragrances, brighteners, etc. |

The hydrogen peroxide source may be selected from the alkali metal salts of percarbonate, perborate, persilicate and hydrogen peroxide adducts and hydrogen peroxide. Most preferred are sodium percarbonate, sodium perborate mono- and tetrahydrate, and hydrogen peroxide. Other peroxygen sources may be possible, such as monopersulfates and monoperphosphates. In liquid applications, liquid hydrogen peroxide solutions are preferred, but the precursor may need to be kept separate therefrom prior to combination in aqueous solution to prevent premature decomposition.

The buffer may be selected from sodium carbonate, sodium bicarbonate, sodium borate, sodium silicate, phosphoric acid salts, and other alkali metal/alkaline earth metal salts known to those skilled in the art. Organic buffers, such as succinates, maleates and acetates may also be suitable for use. It appears preferable to have sufficient buffer to attain an alkaline pH, i.e., above at least about 7.0.

The filler material, which, in a detergent bleach application, may actually constitute the major constituent, by weight, of the detergent bleach, is usually sodium sulfate. Sodium chloride is another potential filler. Dyes include anthraquinone and similar blue dyes. Pigments, such as ultramarine blue (UMB), may also be used, and can have a bluing effect by depositing on fabrics washed with a detergent bleach containing UMB. Monastral colorants are also possible for inclusion. Brighteners, such as stilbene, styrene and styrylnapthalene brighteners (fluorescent whitening agents), may be included. Fragrances used for esthetic purposes are commercially available from Norda, International Flavors and Fragrances and Givaudon. Stabilizers include hydrated salts, such as magnesium sulfate, and boric acid.

In one of the preferred embodiments in which a monoester compound such as in (I) above is the precursor, a preferred bleach composition has the following ingredients:

| | |
|---|---|
| 15.5% | Sodium Perborate Tetrahydrate |
| 11.9% | Resorcinol Monooctanoate |
| 7.0% | Nonionic Surfactant |
| 15.0% | Sodium Carbonate |
| 50.6% | Sodium Sulfate |
| 100.0% | |

The above composition is formulated to deliver, desirably, 14 parts per million total available oxygen (ppm A.O.), at a pH of about 10.5.

In another one of the preferred embodiments, in which a mixed diester compound as in (III) above is the precursor, a preferred bleach composition has the following ingredients:

| | |
|---|---|
| 15.5% | Sodium Perborate Tetrahydrate |
| 7.0% | Resorcinol Octanoate Acetate |
| 7.0% | Nonionic Surfactant |
| 15.0% | Sodium Carbonate |
| 55.5% | Sodium Sulfate |
| 100.0% | |

The above composition is formulated to deliver, desirably, about 14 ppm A.O. at a pH of about 10.5. Other peroxygen sources, such as sodium perborate monohydrate or sodium percarbonate are suitable. If a more detergent-type product is desired, the amount of filler can be increased and the precursor halved or further decreased.

The novel precursors of this invention are synthesized by the methods which are disclosed below. Additionally, performance results are shown below in the EXPERIMENTAL section.

EXPERIMENTAL

I. Synthesis of 1 Octanoyloxy-3-Hydroxy Benzene

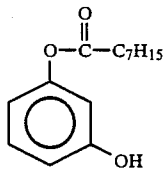

Adapting the method of synthesis disclosed in D. Johnston, "Preparation of Hydroquinone Monoacetate," *Chemistry & Industry* 24:1000 (1982) (which is incorporated herein by reference), it is expected that resorcinol may be combined with about an equimolar amount of dioctanoic acid anhydride, and ethyl acetate solvent, a non-nucleophilic solvent, in the presence of 4-dimethylaminopyridine, a catalyst, and a base, such as triethylamine, at room temperature, to produce the desired 1 octanoyloxy-3-hydroxy benzene (resorcinol monooctanoate).

Therefore, the following procedure was performed:

Resorcinol (2.75 g, 0.025 mole), 4-dimethylaminopyridine (0.3 g, 0.0025 mole), triethylamine (2.5 g, 0.025 mole) were dissolved in 50 ml of ethyl acetate in a 100 ml round bottom flask equipped with a magnetic stir bar. Dioctanoic acid anhydride (6.76 g, 0.025 mole) was added dropwise, via an addition funnel, to the stirred solution over a 100 minute time period.

The resulting solution was stirred for an additional 30 minutes, at which time the solvent was removed via rotary vacuum evaporation. The remaining oil was dissolved in 200 ml of ethyl ether and extracted with a 200 ml portion of 3% HCl to remove the 4-dimethylaminopyridine catalyst, and four 100 ml portions of 5% $NaHCO_3$ were used to remove the octanoic acid byproduct.

After drying the organic phase with 40 grams of $Na_2SO_4$, the ether was removed by rotary vacuum evaporation and the remaining oil was redissolved in 15 ml of chloroform. The sample was then chromatographed in a column on 200 grams of silica gel G with chloroform/petroleum ether (1:2 vol/vol ratio) and pure resorcinol monooctanoate (2.36 g) was collected. Yields of the desired monoester were typically about 40%(wt.).

Surprisingly, unlike in the synthesis described in Johnston's report, the high yields of desired monoester, resorcinol monooctanoate, were not achieved. However, beneficially, symmetrical diesters, resorcinol dioctanoate, were co-produced in a slightly greater portion (about 50%(wt.)) and available for use in the present invention.

In the foregoing synthesis, and in those depicted in III and IV, it is believed that any of the dihydroxybenzenes are suitable for use as starting materials. If non-nucleophilic solvents are required, as in base catalysis, acetone (dimethyl ketone), ethyl or methyl acetate, tetrachloromethane, dichloromethane, ethylene chloride, chloroform, and others appear appropriate to the synthesis. The catalyst, 4-dimethylaminopyridine, appears to promote transesterification by acting to form a reactive intermediate. Other suitable catalysts may include pyridine and other tertiary aliphatic and aromatic amines. The base, which may act to tie up any carboxylic acid moieties formed in the reaction, may include triethylamine, tetramethyl piperidine, $NaHCO_3$, $Na_2CO_3$, and suitable tertiary amines. In the selection of suitable bases, care must be taken to insure solubility of the ingredients in the reaction. Similarly, if acid catalysis is the chosen route of synthesis, concentrated sulfuric acid, hydrochloric acid, and methanesulfonic acid are among the catalysts of choice known to those skilled in the art.

II. Comparison of Diacyl Peroxide Formation

In order to ascertain the amounts of diacyl peroxide formed when less than a 1.5:1 $H_2O_2$:precursor ratio are used, applicants compared the levels of diacyl peroxide formed when two peracid precursors were separately combined with $H_2O_2$, namely, resorcinol monooctanoate (representing a mono ester functionality of one of the embodiments of the present invention,

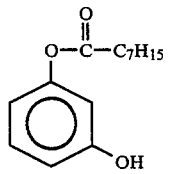

and sodium octanoyloxy benzene sulfonate (NABS),

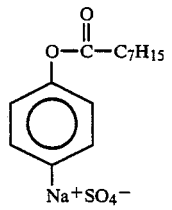

which is one of the activators shown in U.S. Pat. No. 4,412,934.

The two precursors were subjected to the following conditions:

$H_2O_2$: $1.25\times10^{-3}$ M (a) precursor: $1.25\times10^{-3}$ M(predissolved in surfactant)

buffer: 0.02 M $NaHCO_3/NaOH$ pH: 10.5 temperature: 25° C.

(b) all conditions in (a), but $H_2O_2$ at $2.5\times10^{-3}$ M.

The results were:

| | Diacyl Peroxide Content(M) | |
|---|---|---|
| $H_2O_2$/Ester equiv. | Monooctanoate | NABS |
| (a) 1:1 | $0.3\times10^{-4}$ | $2.0\times10^{-4}$ |
| (b) 2:1 | $0.3\times10^{-4}$ | $1.0\times10^{-4}$ |

The results show that at lower than 1.5:1$H_2O_2$:-precursor ratios, the inventive precursors will maintain low amounts of diacyl peroxide. The activators of U.S. Pat. No. 4,412,934, on the other hand, will form significantly higher levels of diacyl peroxide. Comparing the results, it should be noted that the activators of U.S. Pat. No. 4,412,934 produce several times more diacyl peroxide as the precursors of the present invention.

III. Synthesis of 1,3 Dihexanoyloxybenzene

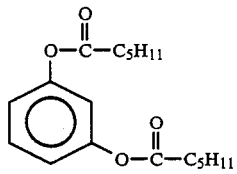

In a reaction vessel, resorcinol is placed with an equimolar amount of hexanoic acid anhydride (from Aldrich Chemicals). Concentrated sulfuric acid (98%) is added to the solution and heated at 100° C. for 3 hours. A crude reaction product was obtained from this acid catalysis containing the 1,3 dihexanoyloxybenzene (resorcinol dihexanoate) and hexanoic acid.

The reaction mixture is diluted with diethyl ether and the hexanoic acid removed by extraction with 5% $NaHCO_3$. The ether phase is dried under $Na_2SO_4$ and rotary evaporated to remove the solvent. For hydroquinone dihexanoate, the resulting solid is recrystallized with $EtOH/H_2O$ to give a pure solid (m.pt. 56°-57° C.). For resorcinol dihexanoate, the liquid is distilled and the product fraction collected at 175-180/0.5 mm Hg. Isolated yields are generally 90% for either synthesis.

IV. Synthesis of 1 Octanoyloxy-3-acetoxy benzene

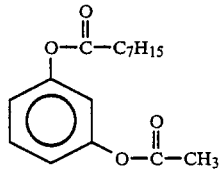

An acetoxylated resorcinol is obtained through commercial sources (from American Hoechst). It is placed in a reaction vessel with an equimolar amount of dioctanoic acid anhydride (from Aldrich Chemicals), in the presence of methanesulfonic acid to promote acid catalysis, and reacted at room temperature (21° C.) for one hour. A 95% yield of the 1 octanoyloxy-3-acetoxy benzene (resorcinol acetate octanoate) and octanoic acid as a by-product results.

The purpose of the next experiment was to see if a greater than 1.5 molar ratio of $H_2O_2$: precursor as contended by U.S. Pat. No. 4,412,934 was actually necessary for the precursors of this invention to give good yields of desired peracids.

V. Yield of 1 Octanoyloxy-3-Acetoxy Benzene a. The compound synthesized in IV (resorcinol acetate octanoate) was combined in aqueous solution with sufficient hydrogen peroxide to yield a hydrogen peroxide: precursor ratio (based on ester equivalents) of about 1.4:1. The reaction conditions were pH 10.5 (based on 0.02 M $NaHCO_3$), temperature 25° C., and 1 g/l liter of a nonionic surfactant, Neodol 25-12 (which is a linear ethoxylated alcohol with predominant chain length of 12-15 carbon atoms, averaging about 12 moles of ethylene oxide per mole of alcohol). The concentration of II (resorcinol acetate octanoate) was $4.375\times10^{-4}$ M, $H_2O_2$ was about $1.225\times10^{-3}$ M, to result in an $H_2O_2$:-precursor (based on ester equivalents) ratio of about 1.4:1. Yields of about 75% peracid were obtained. Low levels of diacyl peroxide were detected consistent with the high peracid yield.

b. Repeating the above experiment, with the compound of IV (resorcinol acetate octanoate) at $4.375\times10^{-4}$ M, but with $1.75\times10^{-3}$ M $H_2O_2$, to result in a ratio of $H_2O_2$:precursor of about 2:1, the resulting yield was about 78%. The reason for the absence of substantial diacyl peroxide formation in a competing side reaction as posited by U.S. Pat. No. 4,412,934 are presently unknown. It is speculated that there is a lack of interaction between the recently formed peracid and that portion of unreacted precursor. This theory is for purposes of explanation and not meant to restrict the scope of the invention. It is also believed that any acetyl octanoyl diacyl peroxide formed may be rapidly re-perhydrolyzed, i.e., converted back into peracid, without the need for a large excess of hydrogen peroxide. Further experiments appear to bear out the low diacyl peroxide formation in the inventive compositions.

Performance tests for the inventive precursors have also been conducted. The precursors have been found to exhibit significant improvements in bleaching performance over a commercial dry perborate bleach:

| Composition | % Stain Removal |
|---|---|
| V. % Satin Removal of Crystal Violet Stained Cotton Swatches of 1,3 Dihexanoyloxy Benzene | |
| $H_2O_2$ + resorcinol dihexanoate[1]/ Neodol 25-12 | 90.45 ± 1.26 |
| $H_2O_2$ + Neodol 25-12 | 76.77 ± 1.24 |
| $H_2O_2$ + resorcinol dihexanoate[1] | 69.85 ± 2.84 |
| Neodol 25-12 | 80.45 ± 1.05 |
| Commercial Bleach (sodium, perborate, brighteners, builders) | 73.45 ± 2.39 |

$H_2O_2 = 2.50 \times 10^{-3}$M
Resorcinol dihexanoate[1] = $6.25 \times 10^{-4}$M
pH 10.5, 0.02M carbonate buffer, 38° C.
10 minutes wash time
Average of 5 swatches in 200 ml wash water
[1]1,3 Dihexanoyloxy Benzene

| VI. % Stain Removal of Crystal Violet/Cotton Swatches of 1 Octanoyloxy-3-Acetoxy Benzene[1] | |
|---|---|
| Buffer only | 29.7 ± 5.7 |
| $H_2O_2$ + Neodol 25-12 | 65.8 ± 1.4 |
| $C_2/C_8$ [1](7 ppm A.O. theoretical) + $H_2O_2$ + Neodol 15-12 | 76.5 ± 1.5 |
| $C_2/C_8$ [1](10 ppm A.O. theoretical) + $H_2O_2$ + Neodol 25-12 | 79.0 ± 1.1 |
| $C_2/C_8$ [1](14 ppm A.O. theoretical) + $H_2O_2$ + Neodol 25-12 | 82.0 ± 0.4 |
| Peracetic acid (7 ppm A.O.) | 50.4 ± 3.0 |
| Peroctanoic acid (7 ppm A.O.) | 83.8 ± 1.9 |

$H_2O_2 = 1.75 \times 10^{-3}$M
pH 10.5 0.02M carbonate buffer 22° C.
10 minutes wash time
Average of 5 swatches in 200 ml wash water
[1]Resorcinol Acetate Octanoate The foregoing description and embodiments of the invention have been presented for purposes of illustration and not intended to restrict the scope of the invention. Other non-limiting embodiments of the invention are possible. For example, standard bleaching and detergent adjuncts may be added to the compositions disclosed. Exemplary of such adjuncts are builders (sodium carbonate, sodium tripolyphosphate, etc.), fillers (e.g., sodium sulfate), brighteners, enzymes (e.g., alkaline proteases), defoaming agents, and the like known to those skilled in the art. Additionally, further esterification of the phenylene diesters may be possible, for example, resulting in tri- and quaternary-, substituted phenylene precursors. The claims hereto further illustrate the invention.

What is claimed is:

1. A bleaching composition comprising:

(a) a source of hydrogen peroxide; and (b) a bleach effective amount of a peracid precursor of the general structure

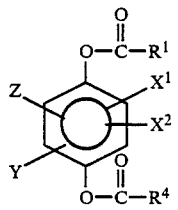

wherein $R^1$ is either an alkyl or a halogen-substituted alkyl, of less than 5 carbon atoms; and $X^1$, $X^2$, Y and Z are individually selected from H, $SO^-_3$, $CO^-_2$, $NO_2$, $NR^{5+}_4$, Halogen, $R^6$, and mixtures thereof;

wherein $R^4$ of

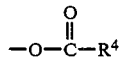

is either an alkyl or a halogen-substituted alkyl, of about 5 to 11 carbon atoms; $R^5$ of $NR^{5+}_4$ is selected from H, alkyl of 1 to 24 carbon atoms and mixtures thereof; $R^6$ is alkyl of about 1 to 20 carbon atoms.

2. The composition of claim 1 further comprising (c) sufficient quantities of buffer to yield an alkaline pH when the composition is placed in aqueous solution.

3. The composition of claim 1 wherein

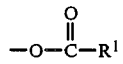

and

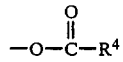

of the precursor are para in relationship to each other.

4. The composition of claim 1 wherein

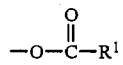

and

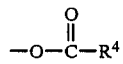

of the precursor are ortho in relationship to each other.

5. The composition of claim 1 wherein

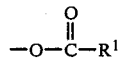

and

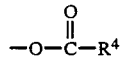

of the precursor are meta in relationship to each other.

6. The composition of claim 1 wherein at least one of $X^1$, $X^2$, Y and Z are $SO^-_3$ with a counterpart ion which is $H^+$ or an alkali metal cation selected from the group consisting essentially of sodium, potassium or lithium.

7. The composition of claim 1 further comprising (d) a surfactant which will not react with the precursor.

8. The composition of claim 7 wherein the surfactant is selected from the group consisting essentially of anionic, nonanionic, zwitterionic, cationic, amphoteric surfactants and mixtures thereof.

9. The composition of claim 8 wherein the surfactant is nonionic.

10. The composition of claim 1 wherein the hydrogen peroxide source is selected from the alkali metal salts of percarbonate, perborate, persilicate and hydrogen peroxide adducts.

11. The composition of claim 10 wherein the hydrogen peroxide source is selected from sodium perborate and monohydrate or tetrahydrate, sodium percarbonate and hydrogen peroxide.

12. The composition of claim 11 wherein the ratio of hydrogen peroxide yielded by the hydrogen peroxide source to the precursor is greater than about 1:1 of hydrogen peroxide to ester equivalent.

13. The composition of claim 1 wherein $R^6$ is substituted with at least one substituent selected from the group consisting essentially of $SO^-_3$, $CO^-_2$, $NR^{5+}_4$, halogen and mixtures thereof, wherein $R^5$ of $NR^{5+}_4$ is further defined as H, alkyl of about 1 to 24 carbon atoms and mixtures thereof.

14. The composition of claim 1 wherein $R^1$ is $CH_3$ and $R^4$ is $C_{5-11}$ alkyl.

15. The composition of claim 14 wherein $R^4$ is $C_{5-8}$ alkyl.

16. The composition of claim 15 wherein the precursor is a phenylene monoacetate monohexanoate.

17. The composition of claim 15 wherein the precursor is a phenylene monoacetate monoheptanoate.

18. The composition of claim 15 wherein the precursor is a phenylene monoacetate monooctanoate.

19. The composition of claim 15 wherein the precursor is a phenhylene monoacetate mononononanoate.

20. The composition of claim 1 wherein at least one of $R^1$ of $R^4$ is halogen substituted at the carbon adjacent a carbonyl group thereof.

21. The composition of claim 1 wherein at least one of $R^1$ or $R^4$ is halogen-substituted at the terminal carbon of the alkyl group thereof.

22. A method of removing soils from fabrics comprising contacting said fabrics with a bleaching composition which comprises:

(a) a source of hydrogen peroxide; and (b) a bleach effective amount of a peracid precursor of the general structure

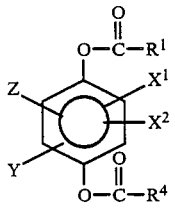

wherein $R^1$ is either an alkyl or a halogen-substituted alkyl, of less than 5 carbon atoms; and $X^1$, $X^2$, Y and Z are individually selected from H, $SO^-_3$, $CO^-_2$, $NO_2$, $NR^{5+}_4$, Halogen, $R^6$, and mixtures thereof;

wherein $R^4$ of

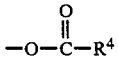

is either an alkyl or a halogen-substituted alkyl, of 5 to 11 carbon atoms; $R^5$ of $NR^{5+}_4$ is selected from H, alkyl or 1 to 24 carbon atoms and mixtures thereof; and $R^6$ is alkyl of about 1 to 20 carbon atoms.

* * * * *